United States Patent [19]

Akizawa et al.

[11] Patent Number: 4,483,441

[45] Date of Patent: Nov. 20, 1984

[54] FLAT-TYPE SEMICONDUCTOR DEVICE AND PACKING THEREOF

[75] Inventors: Tetsuo Akizawa, Musashino; Hiroshi Ishimizu, Yokohama, both of Japan

[73] Assignee: Tokyo Shibaura Denki Kabushiki Kaisha, Kawasaki, Japan

[21] Appl. No.: 356,767

[22] Filed: Mar. 10, 1982

[30] Foreign Application Priority Data

Mar. 26, 1981 [JP] Japan ..... 56-44385
Apr. 7, 1981 [JP] Japan ..... 56-52048

[51] Int. Cl.[3] ..... B65D 85/62; B65D 73/02; H05K 5/00; B65B 1/08

[52] U.S. Cl. ..... 206/328; 206/499; 206/334

[58] Field of Search ..... 206/334, 328, 331, 499

[56] References Cited

U.S. PATENT DOCUMENTS 3,454,154 7/1969 Peters et al. ..... 206/331
3,550,766 12/1970 Nixen ..... 206/328
3,604,557 9/1971 Cedrone ..... 206/331
3,892,312 7/1975 Tems ..... 206/318
4,043,485 8/1977 Tippetts ..... 206/331
4,329,642 5/1982 Luthi et al. ..... 206/328
4,359,157 11/1982 Horstmann ..... 206/328

*Primary Examiner*—William T. Dixson, Jr.
*Attorney, Agent, or Firm*—Finnegan, Henderson, Farabow, Garrett & Dunner

[57] ABSTRACT

A packing for transporting flat-type semiconductor devices which prevents deformation of the lead wires and which improves the transportation efficiency, and a flat-type semiconductor which is particularly suitable for the packing. A flat-type semiconductor device to be used for the packing of the present invention has a protection frame which is partially fixed to a hermetic package sealing a semiconductor element and which protects lead wires. The semiconductor devices are stacked in a container having a bottom. A lid is placed on the semiconductor devices to complete the packing of the present invention. In order to facilitate the removal of the protection frame by the user, the protection frame of the flat-type semiconductor device is fixed to the hermetic package at one side each of four corners.

13 Claims, 12 Drawing Figures

FLAT-TYPE SEMICONDUCTOR DEVICE AND PACKING THEREOF

BACKGROUND OF THE INVENTION

1. Field of the Invention

The present invention relates to a flat-type semiconductor device and a packing thereof and, more particularly, to a packing of a flat-type semiconductor device which is suitable for transportation and a flat-type semiconductor device which is especially suitable for the packing.

2. Description of the Prior Art

A semiconductor device generally has a plurality of lead wires extend outward from the sides of a package in which a semiconductor element is sealed. The semiconductor device with straight lead wires is called a flat-type semiconductor device. A typical example of the flat-type semiconductor device is a quadral inline package (to be referred to as a QIP hereinafter). In a QIP, a package is made of a sealing resin layer and lead wires extend from the side surfaces of the sealing resin layer in four directions. A QIP type semiconductor device will be described as an example of the flat-type semiconductor devices.

FIG. 1 shows a QIP type semiconductor device which is ready to be delivered to a user. A semiconductor element (not shown) is sealed within a sealing resin layer 1. A plurality of lead wires 2 extend from the side surfaces of the sealing resin layer 1. The lead wires 2 are connected to the semiconductor element within the sealing resin layer 1.

The lead wires 2 are formed by punching a single metal plate. In the QIP type semiconductor device, the lead width and lead pitch are narrow. Accordingly, in consideration of manufacturing precision, the thickness of the lead wires is made thin. Therefore, the lead wires of the QIP type semiconductor device have low mechanical strength, resulting in their tendency toward deformation such as bending and distortion. For this reason, careful handling is required for the QIP type semiconductor device. Especially, when it is transported, the following packing method is adopted to prevent the deformation of the lead wires.

That is, as shown in FIG. 2, a packing material 3 made of, for example, polyurethane foam, in which a plurality of equidistantly spaced apart recesses 4 are formed, is used. The sealing resin layer 1 of the QIP type semiconductor device is stored in each recess 4. The size of the recess 4 is slightly larger than that of the sealing resin layer 1. So, the lead wires extend over the surface of the packing material 3, as shown in the figure. A plurality of QIP semiconductor devices are arranged in a plane in this manner. The recesses 4 are spaced apart from each other so as not to allow mutual contact between the lead wires 2. After the QIP semiconductor devices are arranged on the packing material 3 in a plane, they are stacked as shown in FIG. 3, and are packed in a carton box or the like for delivery.

If a packing as described above is used, deformation of the lead wires 2 of the QIP semiconductor devices during transportation can be prevented. Nevertheless, this packing has drawbacks to be described below. Firstly, since the QIP type semiconductor devices are arranged at intervals in a plane, packing density is low, so that transportation efficiency is degraded and transportation cost is increased. Secondly, it is difficult to automatically arrange the QIP type semiconductor devices on the packing material 3 in a plane. Similarly, it is also difficult to automatically take out the semiconductor devices one by one from the packing. This is partially attributable to the fact that the lead wires 2 are easy to deform. Thirdly, since a special packing material 3 is required, the packing cost is increased. Fourthly, the QIP type semiconductors are substantially symmetrical in four directions. Therefore, if the packing step is automatically performed, the QIP type semiconductor devices may be arranged in different directions.

SUMMARY OF THE INVENTION

It is an object of the present invention to provide a packing of a flat-type semiconductor device, according to which lead wires may not deform and packing density may be improved.

It is another object of the present invention to provide a packing of a flat-type semiconductor device which allows automatic steps of packing in and taking out of the semiconductor devices from the packing.

It is still another object of the present invention to provide a packing of a flat-type semiconductor device, which does not require a special packing material and which allows a reduction in the packing cost.

It is further object of the present invention to provide a flat-type semiconductor device which is particularly suitable for a packing as described above.

It is still further object of the present invention to provide a method for transporting a flat-type semiconductor device, which prevents deformation of lead wires and which allows a reduction in the transportation cost.

In order to achieve the above and other objects, there is provided according to the present invention a packing of a flat-type semiconductor device which comprises:

a container having a bottom;

a plurality of flat-type semiconductor devices which are packed in said container in stacked layers; and a fixed first lid which covers said plurality of flat-type semiconductor devices, wherein said flat-type semiconductor device includes a package sealing a semiconductor element therein;

a plurality of lead wires which are connected to said semiconductor element within said package and which extend straight from side surfaces of said package; and a protection frame for protecting said lead wires, which is arranged on the outside of the tips of said lead wires and which is fixed to said package.

DETAILED DESCRIPTION OF THE PREFERRED EMBODIMENTS

Figure 1:
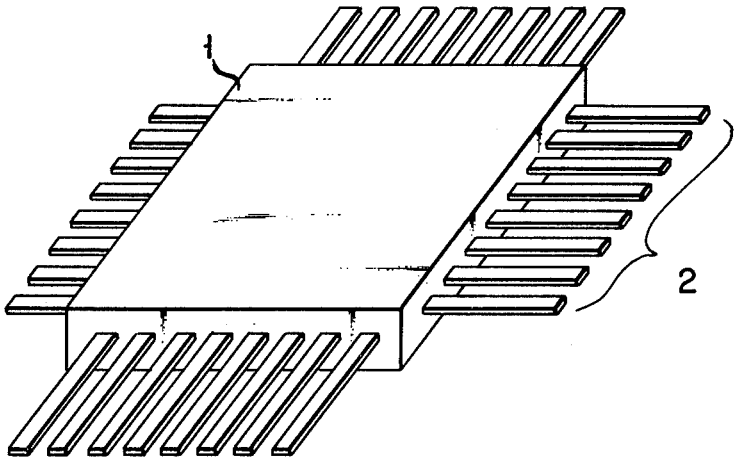
FIG. 1 (PRIOR ART)
FIG. 1 is a perspective view showing a flat-type semiconductor device in the step of delivery according to a conventional method.
Figure 2:
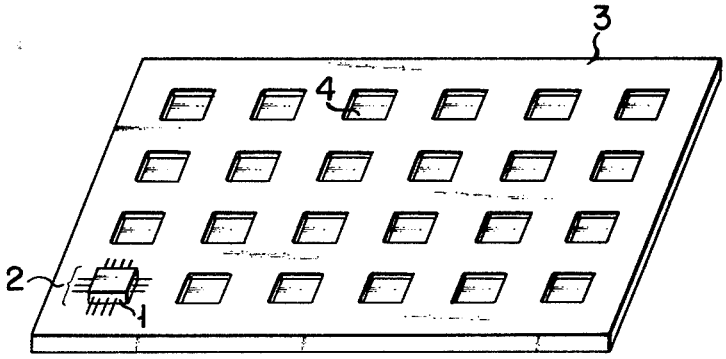
FIG. 2 (PRIOR ART)
FIGS. 2 and 3 are views showing packed conditions of flat-type semiconductor devices according to the conventional method.
Figure 3:
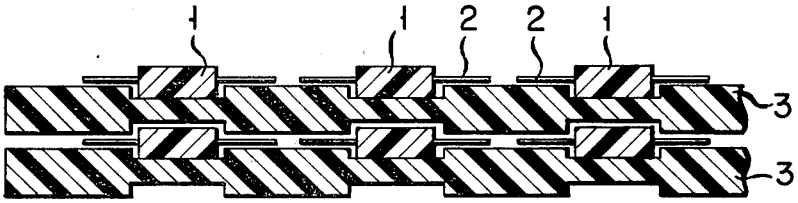
FIG. 3 (PRIOR ART)
Figure 4:
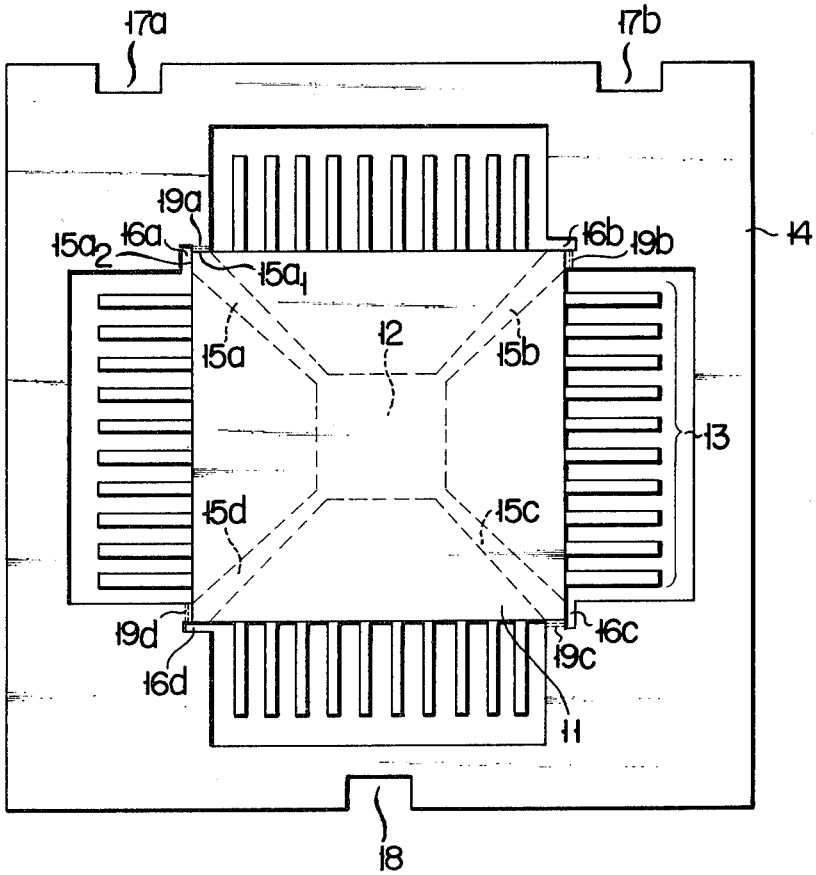
FIGS. 4, 5 and 6 are views showing different embodiments of flat-type semiconductor devices which are particularly suitable for a packing of the present invention.

The most important problem in the transportation of flat-type semiconductor devices is deformation of the lead wires. In order to prevent deformation of the lead wires, a flat-type semiconductor device to be used with a packing of the present invention has a structure as shown in FIG. 4. A semiconductor element (not shown) is mounted on a mount substrate 12 and is sealed within a sealing resin layer 11. The mount substrate 12 is suspended by a protection frame 14 through bridges 15*a* to 15*d*. A plurality of lead wires 13 extend from each side of the sealing resin layer 11. The tips of the lead wires 13 are separated from the protection frame 14. Inside the sealing resin layer 11, the lead wires 13 are connected to the semiconductor element (not shown). Parts of the lead wires 13 which are covered with the sealing resin layer are omitted from the figure. The mount substrate 12, the lead wires 13, the protection frame 14, and the bridges 15*a* to 15*d* are on the same plane since they are formed by punching a single metal plate. The bridges 15*a* to 15*d* are connected to the protection frame 14 at the four corners of the sealing resin layer 11. Therefore, it looks that the protection frame 14 is connected to the four corners of the sealing resin layer 11. The connection between the protection frame 14 and the bridges 15*a* to 15*d* will be described, taking the case of the bridge 15*a* as an example. Terminal edges $15a_1$ and $15a_2$ of the bridge 15*a* are on two different, adjacent sides of the sealing resin layer 11. A cutting groove 16*a* is formed on the protection frame 14 at the side of the terminal edge $15a_2$. The terminal edge $15a_2$ is thus separated from the protection frame 14. Therefore, the bridge 15*a* is connected to the protection frame 14 at the terminal edge $15a_1$ alone which is on one side of a corner portion of the sealing resin layer 11. A groove 19*a* extends in the terminal edge $15a_1$ lengthwise thereof. Two notches 17*a* and 17*b* are formed in the protection frame 14 at one side thereof. One notch 18 is formed in the protection frame 14 at the opposing side thereof.

As described, in a semiconductor device used for a packing of the present invention, since the lead wires 13 are protected by the protection frame 14, the lead wires 13 may not deform during transportation. Furthermore, since the protection frame 14 is incorporated, it becomes easy to automatically pack in and take out the semiconductor devices from the packing as will be described later.

It is to be noted that the protection frame 14 must be removed when the semiconductor devices are actually mounted on the inside of a machine or the like. In the semiconductor device described above, since the protection frame 14 is fixed to the sealing resin layer 11 at a corner where the lead wires are not present, the possibility of deformation of the lead wires during removal of the protection frame 14 is minimized. In the semiconductor device described above, the bridge 15*a* is connected to the protection frame 14 at one corner of the sealing resin layer 11 through one terminal edge $15a_1$ which is at one side of the sealing resin layer 11. In addition to this, the groove 19*a* is formed on the terminal edge $15a_1$ lengthwise thereof. Therefore, the protection frame 14 may be snapped off at the terminal edge $15a_1$ by bending up and down the protection frame 14 several times with clamping the portion of the protection frame 14 close to the fixed portion with the fingers of one hand and clamping the corner portion of the sealing resin layer 11 with the fingers of the other hand. It will be readily understood such snap is difficult if both the terminal edges $15a_1$ and $15a_2$ are connected to the protection frame 14. Thus, according to a semiconductor device of this embodiment, it is possible to remove the protection frame 14 without requiring the set of a press machine. Even if a press machine is used, only a relatively simple press machine need be used. For this reason, removal of the protection frame 14 can easily be done by the user.

Two notches 17*a* and 17*b* are formed in the protection frame 14 at one side thereof, and one notch 18 is formed in the protection frame 14 at the opposite side thereof. The protection frame 14 is therefore not symmetrical about a point and only one axis of symmetry exists. Accordingly, it is possible to readily differentiate the orientation of the semiconductor device according to the positions of the notches. If the shape of the protection frame 14 is symmetrical about a point or is symmetrical about 2 or more lines, it is not possible to know the orientation of the semiconductor device from the positions of the notches. These notches also facilitate the packing of the semiconductor devices into a container of the packing as will be described later.

Figure 5:
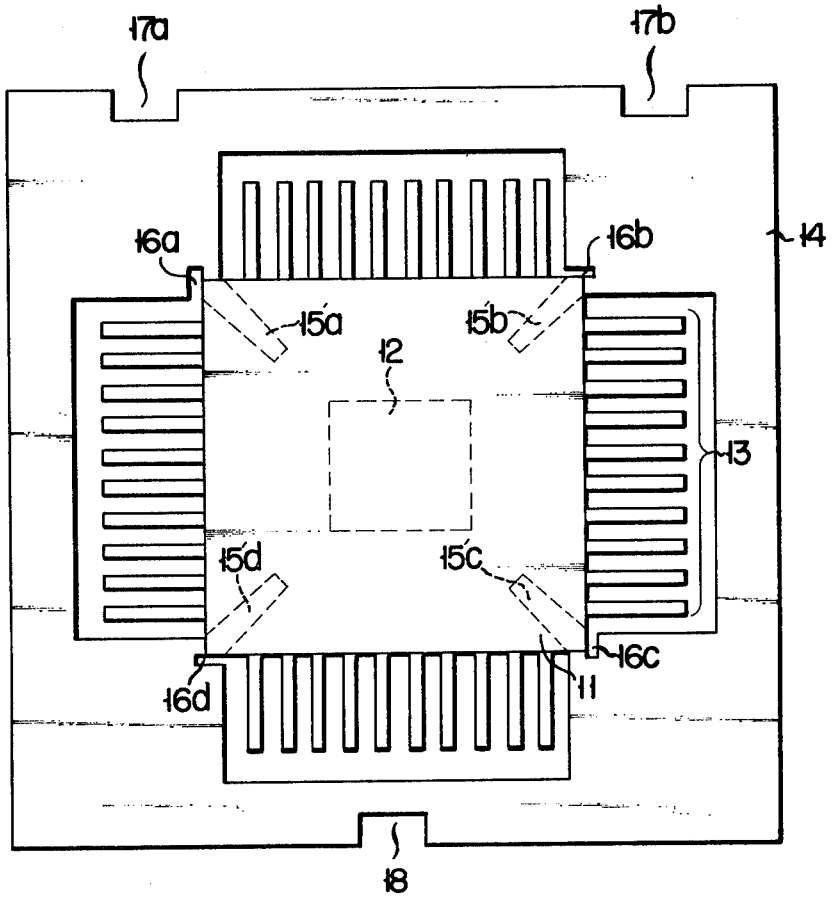

FIG. 5 shows another embodiment of a QIP type semiconductor device which can be used with a packing according to the present invention. In this embodiment, the protection frame 14 is not connected to the mount substrate 12. The protection frame 14 is fixed to the sealing resin layer 11 by fixing pieces 15'*a* to 15'*d* which project inward from four corners of the sealing resin layer 11. The rest of the structure is the same as the embodiment shown in FIG. 4.

Figure 6:
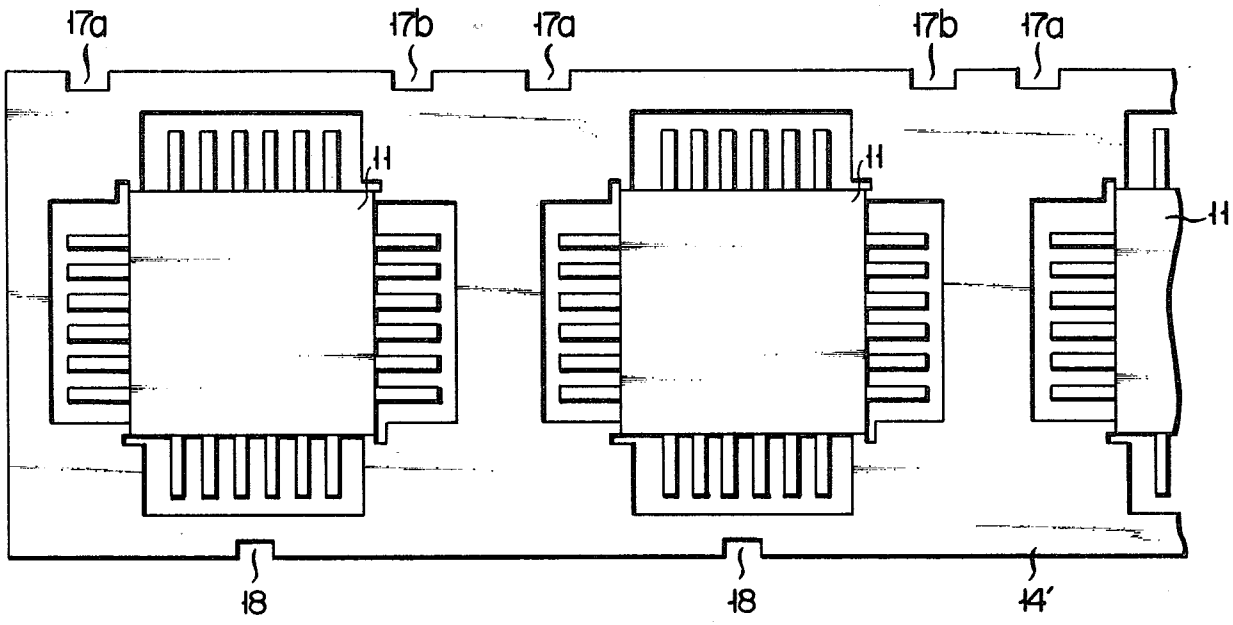

FIG. 6 shows a series of a plurality of QIP type semiconductor devices which are formed integrally with each other by a protection frame 14'. The lead frame used for the manufacture of resin-sealed type semiconductor device originally consists of a plurality of continuous units. Therefore, the outer frame of such a lead frame may be used as a protection frame 14' without any modification.

In flat-type semiconductor devices used with the packing according to the present invention, the lead wires 13 are protected by the protection frame. The only requirement of such a semiconductor device is that the lead wires be protected by a protection frame as will be described later.

Figure 7:
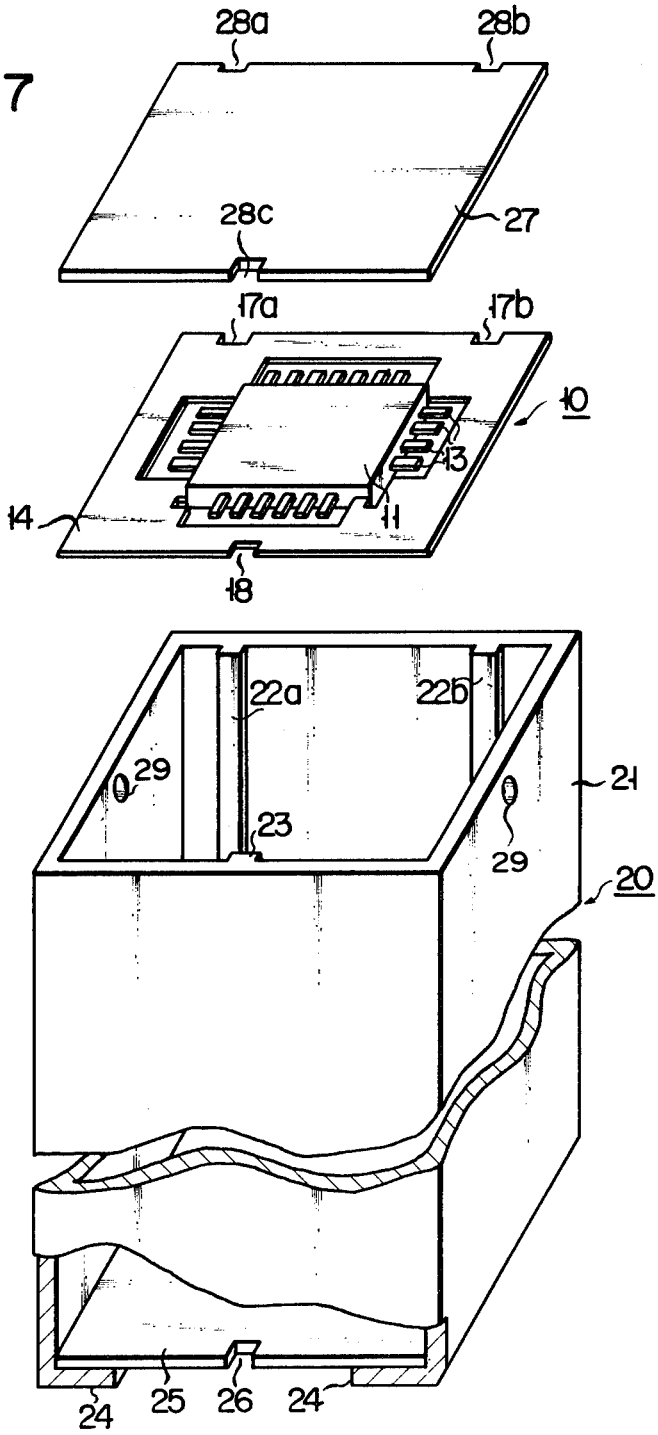
FIG. 7 is an exploded view of a packing according to the present invention.

An embodiment of the packing of the present invention will now be described with reference to FIG. 7. FIG. 7 is an exploded view of the packing of the present invention. The packing comprises a hollow-pillar shaped enclosure 21 with both ends open, a bottom lid 25, a flat-type semiconductor device 10 to be packed therein, and a top lid 27. The cross section of the enclosure 21 has a shape substantially the same as the outer rim of the protection frame 14. Stopper projection 24 for stopping the bottom lid 25 are arranged at the lower end of the enclosure 21. Guide projections 22*a*, 22*b* and 23 are formed on the inner wall of the enclosure 21 in correspondence with the notches 17*a*, 17*b* and 18 of the semiconductor device 10 and in the direction of height of the enclosure 21. In the bottom lid 25 are formed a notch 26 in correspondence with the guide projection 23 and notches (not shown) in correspondence with the guide projection 22*a* and 22*b*. In a similar manner, notches 28*a*, 28*b* and 28*c* are formed in the top lid 27. Through holes 29 are formed at upper parts of opposing side walls of the enclosure 21.

The packing of the present invention is assembled in the manner to be described below. First, the bottom lid 25 is placed at the bottom of the enclosure 21. In order to do so, the bottom lid 25 is slid along the guide projections in a manner that the guide projection 23 is fitted in the notch 26 and the guide projection 22*a* and 22*b* are fitted in the corresponding notches (not shown), and is stopped by the stopper projection 24. In this manner, a container 20 consisting of the enclosure 21 and the bottom lid 25 is formed. The semiconductor device 10 is placed in the container 20 in the same manner as in the case of the bottom lid 25. That is, the guide projection 23 is fitted in the notch 18, and the guide projections 22*a* and 22*b* are fitted in the notches 17*a* and 17*b* respectively. Under this condition, the semiconductor device 10 is slid toward the bottom along the guide projections and is placed on the bottom lid 25. In the same manner, a plurality of semiconductor devices are placed and stacked in the container 20. After all of the semiconductor devices to be packed are placed in the container, the top lid 27 is finally placed on the stacked semiconductor devices in the enclosure 21. The packing of the present invention is completed when this top lid 27 is fixed.

Figure 9:
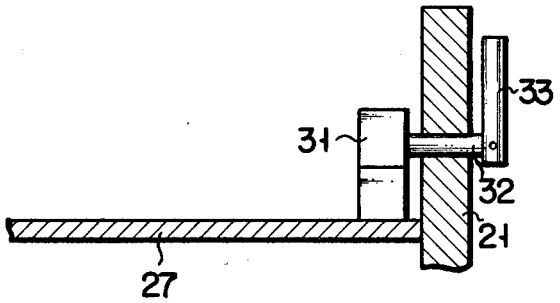
FIG. 9 is a view showing the fixed condition of the top lid when the fixing member shown in FIG. 8 is used.
Figure 8:
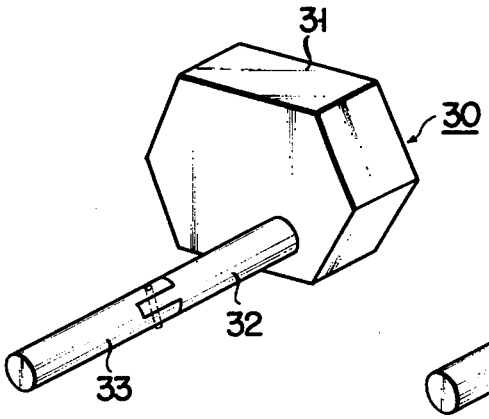
FIGS. 8, 10 and 11 are perspective views showing different embodiments of a fixing member which is used for fixing the top lid of the packing according to the present invention.

FIG. 8 shows an embodiment of a fixing member for fixing this top lid 27. A fixing member 30 comprises a hexagonal press member 31, a connecting shaft 32 mounted eccentrically to the press member 31, and a stopper 33 which also functions as a handle which is mounted to the front end of the connecting shaft 32 so as to be free to bend. FIG. 9 shows the manner according to which the top lid 27 is fixed by this fixing member 30. After placing the top lid 27 on the stack of semiconductor devices, the stopper 33 and the connecting shaft 32 are inserted into the through hole 29 (FIG. 7) from the interior of the enclosure 21 while the stopper 33 is kept straight. Next, the stopper 33 extending outward from the enclosure 21 is bent perpendicularly to the connecting shaft 32. Finally the stopper 33 which is bent perpendicularly to the connecting shaft 32 is rotated to thereby rotate the press member 31 about the connecting shaft 32. Since the connecting shaft 32 is eccentrically mounted to the hexagonal press member, the top lid 27 is urged downward and is then fixed to one side of the press member 31 under pressure upon the rotation of the press member 31, as shown in FIG. 9.

Figure 10:
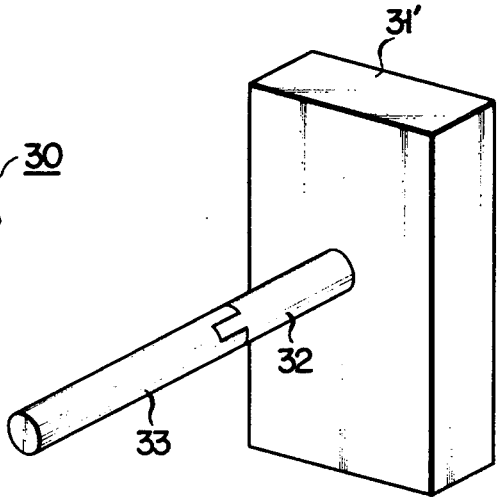
Figure 11:
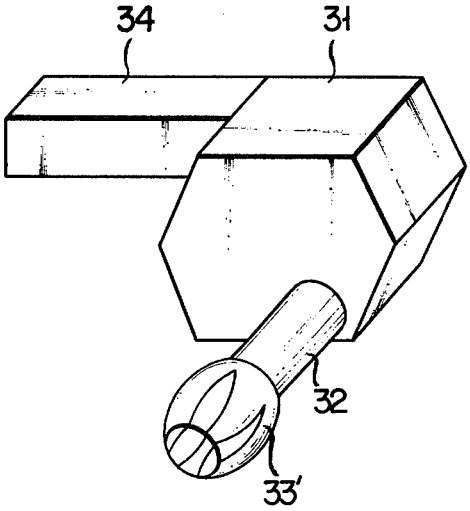

The fixing member may include a polygonal press member other than a hexagonal press member, for example, a rectangular parallelepiped press member 31' as shown in FIG. 10. In this case, the connecting shaft 32 need not be mounted eccentrically to the press member 31 and may be mounted to the central position of the press member 31. Alternatively, as shown in FIG. 11, it is also possible to directly mount a handle 34 to the press member 31 and to mount a stopper 33' (split pin leaf spring) on the front end of the connecting shaft 32. In this case, first, the stopper 33' and the connecting shaft 32 are inserted into the through hole 29 from the interior of the enclosure 21. The stopper 33' which is inserted under the compressed condition opens outside the enclosure 21, so that removal of the connecting shaft 32 from the through hole 29 of the enclosure 21 is prevented. Then, the handle 34 connected to the press member 31 is rotated inside the enclosure 21 to rotate the press member 31 and to fix the top lid 27 down.

In the packing of this embodiment, since the lead wires 13 of the QIP type semiconductor device are protected by the protection frame 14, the lead wires 13 may not deform during the transportation. Furthermore, since the QIP type semiconductor devices are stacked in the vertical direction, packing density and transportation efficiency is improved as compared to conventional packing wherein the semiconductor devices are arranged in a plane. In addition to this, the packing of the present invention does not require the special packing material 3 which has been conventionally required. Since the top lid 27 is fixed by the fixing member 30 under pressure, there is no play involved in the semiconductor devices during the transportation. Accordingly, the present invention is capable of providing a packing of a flat-type semiconductor device which is capable of preventing deformation of lead wires and which is capable of reducing transportation and packing costs of semiconductor devices.

Figure 12:
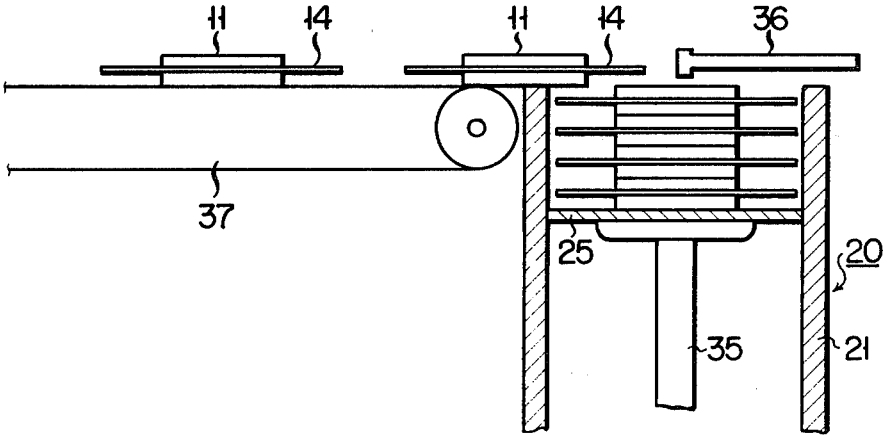
FIG. 12 is a view showing the step for automatically taking out the semiconductor device from the packing according to the present invention.

In the packing of the above example according to the present invention, the lead wires of the semiconductor device are protected by the protection frame and the bottom lid is slidably set, resulting in great advantage. That is, the packing in and taking out of the semiconductor devices from the container may be easily automated. This will be further described with reference to FIG. 12. FIG. 12 shows a case wherein the QIP type semiconductor devices are individually automatically taken out of the container 20. An elevator means 35 for pressing upward the bottom lid 25 is driven to upwardly press the semiconductor devices stacked on the bottom lid 25. A thrust pin 36 thrusts the protection frame of the semiconductor device pressed out of the container 20 to individually transversely thrust the semiconductor device. The thrust semiconductor device is displaced by a belt conveyor 37 to a location at which it is subjected to an operation such as performance measurement. Even when the taking out of the semiconductor device is automated by the thrust pin 36, deformation of the lead wires 13 is prevented by the protection frame 14. The shape of the QIP type semiconductor device is designed so that the orientation of the semiconductor device may readily be differentiated from the positions of the notches 17*a*, 17*b* and 18 formed in the protection frame 14. Furthermore, the semiconductor device is packed in the container along the guide projection formed in correspondence with the notches. Therefore, the orientation of the QIP type semiconductor devices is automatically determined in one direction and the QIP type semiconductor devices may not be packed in the container in various directions.

If the procedure as described above is reversed, the step for stacking the semiconductor devices in the container can also be automated.

In the embodiment described above, the notches 17*a*, 17*b* and 18 are formed in the outer rim of the protection frame 14 of the QIP type semiconductor device and the corresponding guide projections 22*a*, 22*b* and 23 are formed on the inner wall of the enclosure 21. However, it is also possible to form projections on the protection frame of the semiconductor device and to form the corresponding guide grooves in the inner wall of the enclosure.

The stopper projection 24 at the bottom of the enclosure 21 in the embodiment described above may be omitted. Instead, through holes similar to the through holes 29 may be formed. In this case, the bottom lid 25 can be fixed to the enclosure 21 by the fixing member as shown in FIGS. 8, 10 or 11 as in the case of the top lid 27.

In the embodiment described above, the semiconductor device is fixed in the transverse direction by the fitting engagement of the notches 17*a*, 17*b* and 18 with the guide projections 22*a*, 22*b* and 23. Therefore, the semiconductor devices may be securely packed even if the cross-sectional shape of the interior cavity defined by the enclosure 21 is not identical to the shape of the outer rim of the protection frame 14.

A high packing density may be attained even if, in the embodiment described above, the notches 17*a*, 17*b* and 18 are not formed in the protection frame 14 and the guide projections 22*a*, 22*b* and 23 are not formed on the inner wall of the enclosure 21, or the bottom lid 25 is not slidably mounted. Therefore, the main advantageous effects of the present invention, that is, higher transportation efficiency and lower transporation cost may still be attained.

The only requirement of the packing of the present invention is that the flat-type semiconductor devices with lead wires protected by the protection frame be stacked in the container having a bottom and the upper opening of the container be covered with the top lid. Since the requirement of the flat-type semiconductor device to be used for the packing of the present invention is that the lead wires be protected by the protection frame, it is to be understood that the semiconductor device to be used for the packing of the present invention is not limited to those embodiments which are shown in FIGS. 4 to 6. Although the protection frame is fixed to the hermetic package, it need not be directly fixed to the package as in the embodiment described above but may be fixed to the package through the lead wires.

The semiconductor devices to be used in the present invention are not limited to QIP type semiconductor devices but may be flat-type semiconductor devices of other types such as DIP type semiconductor devices.

The flat-type semiconductor devices are generally manufactured complete with the protection frames. The protection frames are then removed immediately before packing the semiconductor devices for delivery. However, the present invention is based on the idea that the semiconductor devices be transported to the user with the protection frames, and provides a packing which is capable of attaining high packing density and automation of the taking out of the semiconductor devices from the container. If the semiconductor devices are delivered to the user with the protection frames attached thereto, the user must remove the protection frames from the semiconductor devices before mounting them to machines. Therefore, the present invention also provides a flat-type semiconductor device from which the protection frame can be particularly easily removed, thereby facilitating the practical application of the packing of the present invention.

As has been described in detail above, the packing of the present invention brings about various advantages such as higher transportation efficiency, lower transportation cost, and easy automation of the steps for packing in or taking out the semiconductor devices from the container.

Semiconductor devices experimentally manufactured by the present inventors to be used for the packing of the embodiment of the present invention were of large size which are to be mounted on automobiles or the like. The packages for semiconductor devices of large size of this type are conventionally made of ceramics. However, the present inventors manufactured the packages out of plastic. As a result, a resin-sealed semiconductor device which may replace the conventional ceramic-sealed semiconductor device was obtained.

What we claim is:

1. A packing for semiconductor devices comprising:

a plurality of flat-type semiconductor devices each having a plurality of lead wires connected to a semiconductor element and extending straight from the side surfaces of the semiconductor element;

a plurality of protection frames, a single protection frame surrounding each of the semiconductor elements and its corresponding lead wires for protecting said lead wires, each protection frame being aligned with and fixed to its respective semiconductor element and being made from the same metal plate as the lead wires so that the lead wires and the protection frame are a unitary structure;

an open container having an inner cavity for accepting the plurality of flat-type semiconductor devices and their respective protection frames in a stacked relationship, said container having a bottom and at least one longitudinal guide projection formed on the inner wall of said container;

each protection frame having at least one notch formed in the outer periphery of said protection frame for accepting said guide projection of the container, the notch being formed such that said protection frame is not symmetrical about a point and has less than two axes of symmetry so that the orientation of the plurality of the flat-type semiconductor devices may be differentiated;

the plurality of flat-type semiconductor elements and their respective protection frames being packed in said container in stacked layers with the guide projection of the container fitting within the notches of the protection frame; and a top lid for covering said plurality of flat-type semiconductor devices stacked within said container.

2. The packing according to claim 1 wherein the cross-sectional shape of the inner cavity defined by said container is substantially the same shape as the outer rim of said protective frame.

3. The packing according to claim 1 wherein said container comprises a hollow pillar shaped enclosure with openings at both ends and wherein the bottom of said container comprises projections formed on the inner wall of said container at the bottom of said container and a bottom lid slidably received within the cavity of said container and resting upon said projections.

4. The packing according to claim 1 wherein said top lid includes a notch corresponding to said guide projection wherein said top lid is slidable within the cavity of said container.

5. The packing according to claim 4 wherein said top lid is placed over said plurality of stacked flat-type semiconductor devices.

6. The packing according to claim 5 further comprising means for pressing the top lid against the plurality of flat-type semiconductor devices and fixing the top lid in place.

7. The packing according to claim 6 wherein said pressing and fixing means includes an aperture in said container, an eccentric press member for engaging the top lid, a shaft eccentrically fixed to said press member for extending through said aperture, and means for rotating said shaft and press member until the press member engages and presses the top lid against the plurality of stacked semiconductor devices.

8. The packing according to claim 7 wherein said press member has a plurality of press surfaces which are unequal distances from said shaft.

9. The packing according to claim 1 wherein said container is of a rectangular shape, said protection frame is of a rectangular shape, and said protection member is fixed to said semiconductor element at each of the four corners of the semiconductor.

10. The packing according to claim 9 wherein a groove is formed in said protection frame in the vicinity of a location where the protection frame is fixed to said semiconductor element such that cutting off said protection frame from said semiconductor element can be facilitated by said groove.

11. A flat-type semiconductor device for transportation and testing comprising:

a rectangular package in which a semiconductor element is sealed;

a plurality of lead wires connected to said semiconductor element and extending straight from the side surfaces of said semiconductor element;

a protection frame surrounding said semiconductor element and its corresponding lead wires for protecting said lead wires, each protection frame being aligned with and fixed to its respective semiconductor element and being made from the same metal plate as the lead wires so that the lead wires and the protection frame are a unitary structure; and at least one notch formed in the outer periphery of said protection frame, said notch being formed such that such protection frame is not symmetrical about a point and has less than two axes of symmetry so that the orientation of said flat-type semiconductor device may be differentiated.

12. The semiconductor device according to claim 11 wherein said protection frame is fixed to said package at one side each of the four corners of said package.

13. The semiconductor device according to claim 12 wherein grooves are formed in said protection frame in the vicinity of the locations where the protection frame is fixed to said package such that cutting off said protection frame from said package can be facilitated by said grooves.

* * * * *